United States Patent [19]

McGowan

[11] Patent Number: 4,594,157

[45] Date of Patent: Jun. 10, 1986

[54] INLET CLAMP AND SCREEN

[76] Inventor: Bernard J. McGowan, 657 Thayer St., Philadelphia, Pa. 19134

[21] Appl. No.: 688,023

[22] Filed: Dec. 31, 1984

[51] Int. Cl.[4] ..... E01F 5/00

[52] U.S. Cl. ..... 210/163; 404/4

[58] Field of Search ..... 210/163; 404/4, 5

[56] References Cited

U.S. PATENT DOCUMENTS

| | | | |
|---|---|---|---|
| 468,714 | 2/1892 | Whitten . | |
| 505,130 | 9/1893 | Ryan | 404/5 |
| 543,740 | 7/1895 | Kuhns | 210/163 |
| 557,786 | 4/1896 | Ensign | 210/163 |
| 672,868 | 4/1901 | Banwell . | |
| 693,511 | 2/1902 | Garrett et al. | 210/163 |
| 783,556 | 2/1905 | Van Buskirk | 210/163 |
| 1,434,677 | 11/1922 | Burton | 404/4 |
| 1,473,551 | 11/1923 | Gschwind | 404/5 |
| 1,659,364 | 2/1928 | Kelley . | |
| 2,159,752 | 5/1939 | Shaw . | |
| 2,473,279 | 6/1949 | Crocker | 404/4 |
| 3,587,239 | 6/1971 | Feland | 138/96 |
| 3,797,188 | 3/1974 | Mansfeld | 52/396 |
| 3,914,911 | 10/1975 | Paasch | 52/180 |
| 3,945,746 | 3/1976 | Bredbenner | 404/4 |

FOREIGN PATENT DOCUMENTS

| | | | |
|---|---|---|---|
| 2376918 | 8/1978 | France | 404/4 |
| 2536 | of 1899 | United Kingdom | 210/163 |
| 470992 | 8/1937 | United Kingdom | 404/5 |

*Primary Examiner*—Tim Miles

*Attorney, Agent, or Firm*—Steele, Gould & Fried

[57] ABSTRACT

A clamp for affixing to a cover over a storm sewer inlet to mount a screen to protect the curb entrance to the sewer, comprising a generally F-shaped bracket.

20 Claims, 5 Drawing Figures

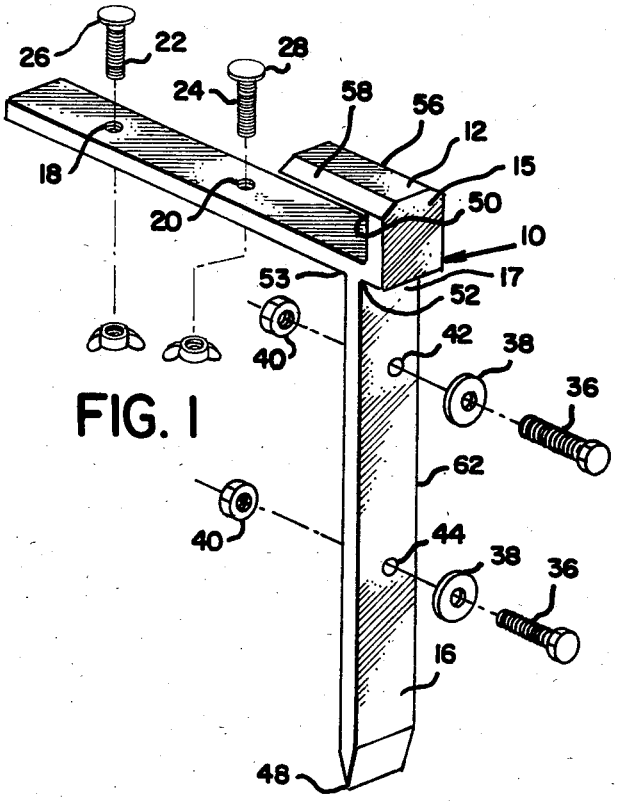
FIG. 1
FIG. 2
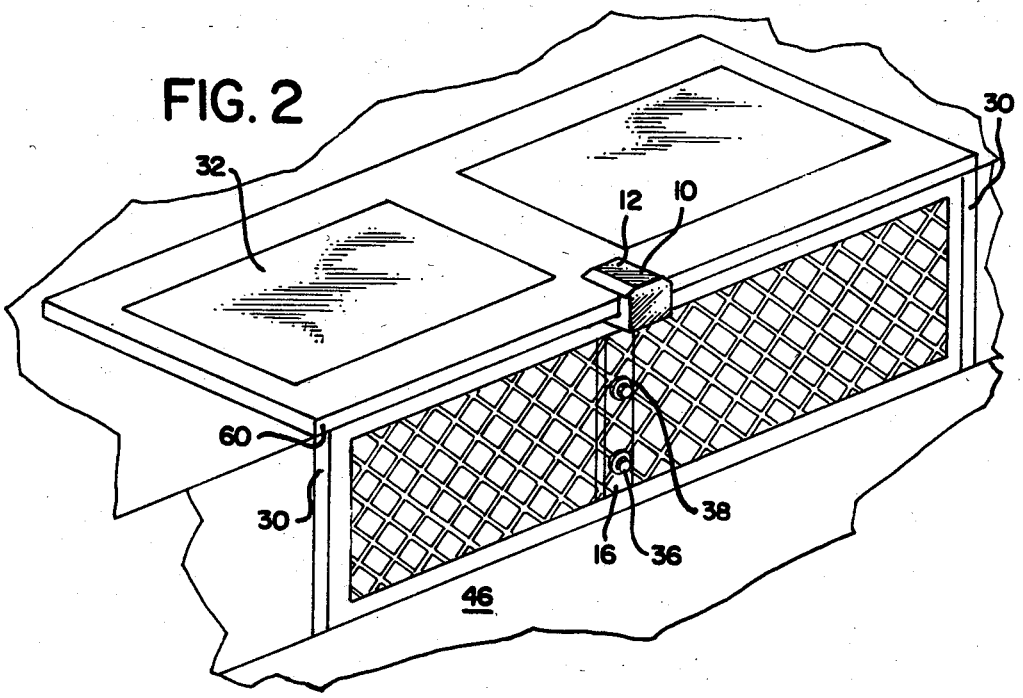

INLET CLAMP AND SCREEN

BACKGROUND OF THE INVENTION

1. Field of the Invention

The present invention relates generally to the field of municipal sewer inlets, and more particularly, is directed to an inlet clamp and screen to protect the curb entrance opening to a municipal storm sewer.

2. Discussion of the Prior Art

It is the usual practice in and about the majority of built-up urban areas to provide an underground stormwater drainage system to carry rain water run-off to suitable point of discharge, such as a natural river or stream. The underground systems must be provided with a plurality of judiciously placed inlets which are positioned at ground level to permit the storm water run-off to enter the sewer. The underground stormwater drainage systems usually are fabricated of steel, concrete or other material pipes or they can comprise streams or underground drainage ditches, or perhaps combinations of the two. In those localities where paved streets, curbs and sidewalks are in place, it is the usual practice to position the sewer inlets directly in the sidewalk through the curb to thereby provide easy entrance for stormwater as it falls upon the streets and other paved areas. Most often, the municipal sewer inlets which are positioned in the curbs comprise a contiguous opening in the sidewalk and curb and a cast iron cover which horizontally overfits and protects the opening in the sidewalk. The curbs usually are completely unprotected and simply present an opening in the curb construction to receive therein the stormwater run-off from the street. Suitable pipes, culverts, branch connectors, manholes and the like of known construction have been employed in well known manner to convey the stormwater from the inlet to the underground drainage system. Usually, when the inlet is positioned directly in the street, a suitable heavy cast iron grate is employed in planar alignment with the paved street area to offer a degree of protection to passersby and to vehicles by providing sufficient obstruction at the inlet to prevent damage or injury which could be caused by inadvertent entrance into the inlet opening construction. However, so far as is known to the applicant, no comparable protection has been designed for curb type sewer inlet openings and the need remains to provide a sturdy, easily installed screen or grate which can be positioned over a curb type sewer inlet to prevent the entrance into the sewer of unwanted foreign objects.

SUMMARY OF THE INVENTION

The present invention relates generally to the field of storm sewer inlets, and more particularly, is directed to an easily installed protecting screen and clamp for use with both new and existing inlet constructions.

The inlet clamp and screen of the present invention comprises one or more generally F-shaped clamps which are suitable for easy, field attachment to the usual cast iron sewer inlet cover. Each clamp may be fabricated of steel or cast iron to an F-shaped configuration in known manner and comprises generally an upper horizontal leg, a lower horizontal leg which is spaced from the upper leg by a vertical distance that is greater than the thickness of the cast iron sewer inlet cover and a vertical support leg which is affixed either to the lower horizontal leg or to both the upper horizontal leg and the lower horizontal leg. Preferably, the support leg extends in length a distance at least equal to the height of the sewer inlet cover above the street surface to thereby extend completely from the cover to the surface of the street for support purposes.

The lower horizontal clamp leg is provided with one or more spaced, threaded openings within which are threadedly mounted conventional thumb bolts which are oriented with their heads facing downwardly. By turning the thumb bolts within the threaded openings in the lower horizontal leg to bear against the under surface of the inlet cover, the clamp may be easily and sturdily affixed to the sewer inlet cover without requiring any special tools or any particular skill.

The vertical support leg of each clam preferably is recessed from the forward terminus of the lower leg and is provided with one or more openings therethrough of size sufficient to receive therein a threaded bolt. A sewer inlet protecting a screen extends substantially over the entire height and width of the opening of the sewer inlet within the recess defined by the vertical support leg and can be secured in place by utilizing suitable bolts, nuts and washers to affix the screen to the clamp or clamps at the respective vertical support legs thereof. In a preferred embodiment, the vertical support leg may terminate downwardly in a pointed end whereby the end of a leg can be embedded into the street construction to provide an extremely sturdy, easily constructed and essentially permanent reinforcing installation. In addition to preventing leaves, paper and other debris from entering the sewer inlet, the screen serves an important safety function by preventing the entrance of balls , toys, etc., an occurrence which might cause a child to attempt to enter the sewer inlet to retrieve the lost object.

It is therefore an object of the present invention to provide a novel inlet clamp and screen of the type set forth.

It is another object of the present invention to provide an improved inlet clamp and screen which includes one or more generally F-shaped clamps of design and dimensions to easily affix to an existing cast iron sewer inlet cover and to provide a vertical support leg surface for affixing a vertically oriented screen thereto to cover the sewer inlet opening.

It is another object of the present invention to provide a novel inlet clamp and screen for securing to a horizontal sewer inlet cover which comprises generally an F-shaped clamp, the clamp having an upper horizontal leg which upwardly covers a portion of the top of the inlet cover and a lower horizontal leg which partially covers a portion of the lower surface of the sewer inlet cover, a vertical support leg joining the upper and lower legs, the support leg extending vertically over the portion of the sewer inlet opening, a protective screen to cover at least a major portion of the sewer inlet opening, means to secure the clamp to the sewer inlet cover and means to secure the protective screen to the clamp vertical support leg.

It is another object of the present invention to provide a novel inlet clamp and screen wherein an easily installed clamp is affixed to an existing cast iron sewer inlet cover in a manner to provide a vertical support over a portion of the sewer inlet opening, a screen overfitting the sewer inlet opening forwardly of the clamp, means to easily and securely affix the clamp to the sewer inlet cover and means to easily and securely affix the screen to a vertical portion of the clamp in a manner to provide an inexpensive and extremely sturdy sewer inlet opening protective covering.

It is another object of the present invention to provide a novel inlet clamp and screen that is inexpensive in manufacture, simple in design and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a perspective view of the sewer inlet clamp of the present invention with the inlet cover and protective screen fastening means illustrated in exploded relationship.

FIG. 2 is a perspective view showing the inlet clamp and screen of the present invention in use.

DESCRIPTION OF THE PREFERRED EMBODIMENT OF THE INVENTION

Figure 3:
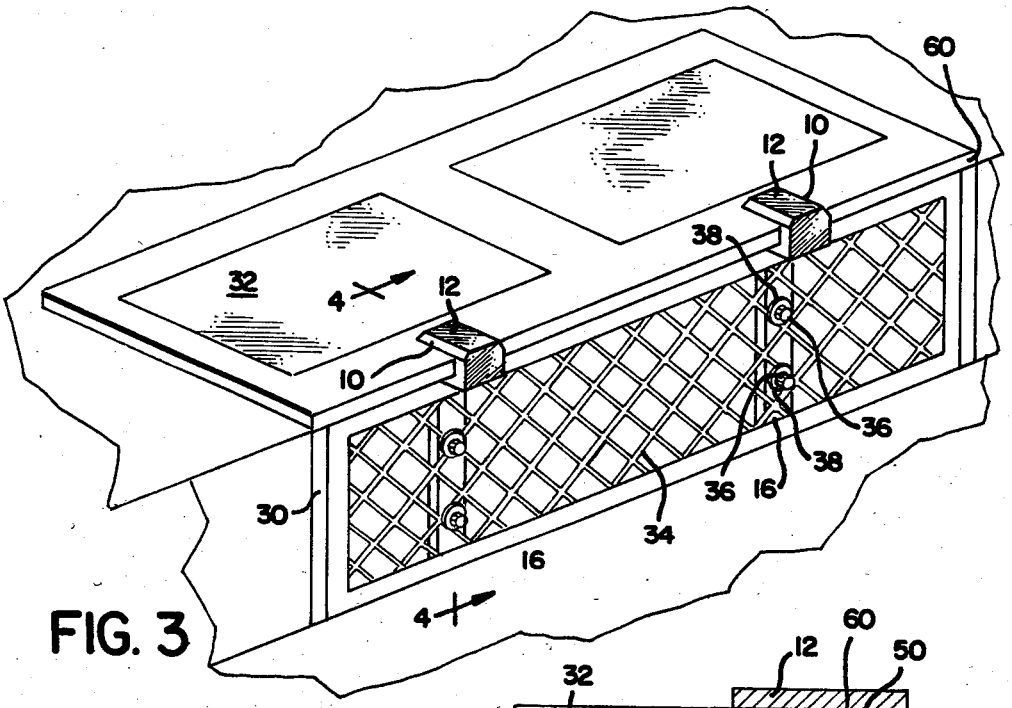
FIG. 3 is a perspective view similar to FIG. 2 showing a modified installation utilizing two clamps.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIG. 1 a sewer inlet bracket or clamp 10 which is generally F-shaped in configuration and which comprises a vertical support leg 16 and a pair of horizontal, vertically spaced upper and lower legs 12, 14. The legs 12, 14 are interconnected by a sturdy web 15 and as illustrated, in the preferred embodiment, the support leg is recessed inwardly to define a forward recess 17 to mount a screen therein. Preferably, the support leg 16, the web 15 and the upper and lower horizontal legs 12, 14 are all fabricated of similar dimensions, of steel or cast iron stock, approximately two inches in width and one-half inch in thickness. The respective intersections 50, 52, 53 between the upper horizontal leg 12, the vertical web 15 and the lower horizontal leg 14 and the vertical web 15 and the lower leg 14 and the support leg 16 can be made in any well known manner, for example welding, casting, brazing or other sturdy metal joining technique well known to those skilled in the art. In an alternate, somewhat less expensive construction, the vertical support leg 16 and the web 15 could be fabricated of unitary construction by eliminating the recessed offset.

Figure 4:
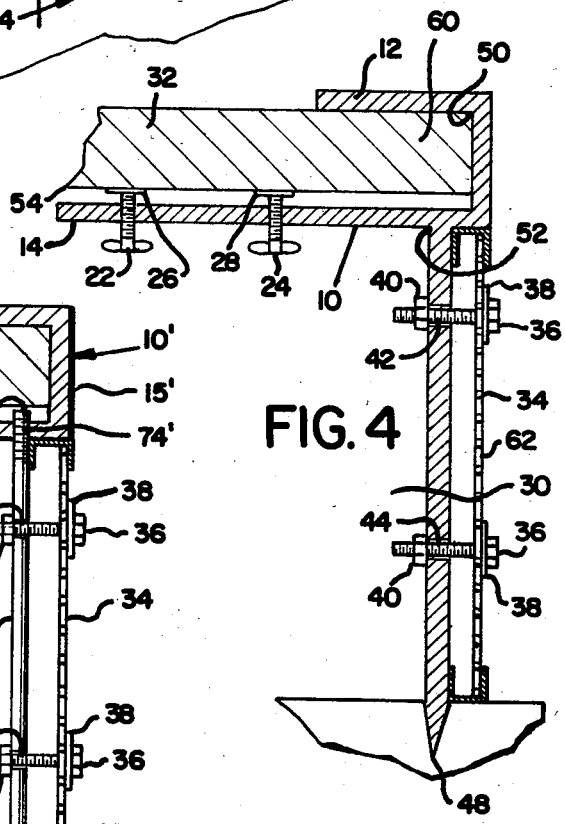
FIG. 4 is an enlarged, cross sectional view taken along line 4—4 on FIG. 3, looking in the direction of the arrows.

The lower horizontal leg 14 is drilled and tapped or otherwise provided with a pair of longitudinally spaced, threaded openings 18, 20 to receive respectively therein the threaded thumb bolts 22, 24. As best seen in FIGS. 1 and 4, the thumb bolts 22, 24 include bearing plates 26, 28 of enlarged diameter to firmly seat against and bear against the under surface 54 of the sewer inlet cover 32 in an easily assembled and extremely sturdy interconnection. The vertical support leg 16 is drilled or otherwise treated to form at least a pair of vertically spaced openings 42, 44 of size to receive therethrough the screen mounting bolts 36 as hereinafter more fully set forth.

As illustrated, the upper horizontal leg 12 endwardly affixes to the top of the vertical web 15 in a welded, bent or other sturdy interconnection 50. Similarly, the lower horizontal leg 14 affixes to the vertical web 15 and the vertical support leg 16 affixes to the lower leg 14 in sturdy interconnectiona 52, 53 whereby the lower leg 14 will be maintained in parallel spaced relationship from the upper leg 12 for sewer inlet cover mounting purposes in the manner hereinafter more fully set forth. It is noted that in the preferred embodiment, the upper leg 12 is fabricated of shorter length than the lower leg 14. However, it should be noted that it is within the meaning and intent of this specification to fabricate the upper leg 12 of other dimensional lengths, for example equal to or greater than the length of the lower horizontal leg 14 if desired or necessary for a particular installation. In the interest of safety, preferably the upper longitudinal corners of the upper leg 12 are longitudinally chamfered at 56, 58 to minimize the chances of anyone stumbling over the upper leg upon installation, inasmuch as the upper leg overfits and upwardly projects from the top surface of the inlet cover 32.

In order to use the clamp and screen of the present invention, one F-shaped clamp 10 as illustrated in FIG. 2 or two or more F-shaped clamps 10 as illustrated in FIG. 3 can be applied rearwardly over the leading edge 60 of a conventional cast iron or other usual sewer inlet cover 32 with the upper and lower legs 12, 14 extending rearwardly to respectively overfit and underfit the cover construction. When the clamp or clamps 10 are fully rearwardly inserted, that is, when the inlet cover leading edge 60 contacts the rearwardly facing surface of the vertical web 15, the clamp or clamps 10 can be secured in position by threadedly turning the thumb bolts 22, 24 until the bearing plates 26, 28 engage upon and secure against the under surface 54 of the sewer inlet cover 32. The thumb bolts 22, 24 serve to secure the clamps in position with the vertical support leg or legs 16 extending downwardly to the street surface 46 in a manner to subdivide the sewer inlet opening 30 into two or more inlet areas.

With the clamp or clamps 10 thus secured in position, an inlet cover screen 34, which preferably approximates the dimensions of the sewer inlet opening 30, is applied over the front surface or surfaces 62 of the vertical support leg or legs 16 in vertical, planar orientation. The screen 34 can be conventionally fabricated of woven wire, intersecting bars, expanded metal, or any other known manner that is suitable for the use. With the screen 34 thus positioned, the plurality of mounting bolts 36 with conventional washers 38 or other securing constructions applied thereon can be positioned through the support leg upper and lower openings 42, 44 and can be secured in position by employing conventional nuts 40 in the usual manner. Alternately, the openings 42, 44 could be threaded and the bolts 36 could then be threadedly engaged therein to secure the screen 34 in vertical orientation over the sewer inlet opening in the illustrated manner. Thus it is seen that the screen 34 can be easily and sturdily affixed over the sewer inlet opening 30 by employing the one or more inlet clamps 10 in the manner illustrated in FIG. 2 or in FIG. 3.

Referring now to FIGS. 1 and 4, in a preferred embodiment, the vertical support leg 16 of a clamp 10 can be fabricated to terminate downwardly in a relatively pointed bottom 48 of configuration which can be urged directly into the street surface 46 by applying sufficient downward pressure thereon. Optionally, a small hole or opening could be formed in the street surface to receive the downward terminus of the vertical leg 16.

In this manner, an extremely sturdy supporting structure can be developed which can be easily installed in a manner to resist both vertical forces which may be downwardly applied upon the clamp 10 or upon the sewer inlet cover 32 and lateral forces which may be applied directly against the vertical support leg 16 or the protective screen 34. Should threaded openings 42, 44 be formed in the clamp support leg 16 to secure the protective screen 34, the need to employ the nuts 40 can then be obviated. As another embodiment or construction modification, the bottom 48 of the vertical support leg 16 could be formed blunt rather than pointed to bear directly on the surface of the street rather than be embedded into the street construction as illustrated. Such a clamp design, if used, would be equally resistant to vertical loading forces, but would be a somewhat less efficient to resist laterally applied forces.

Figure 5:
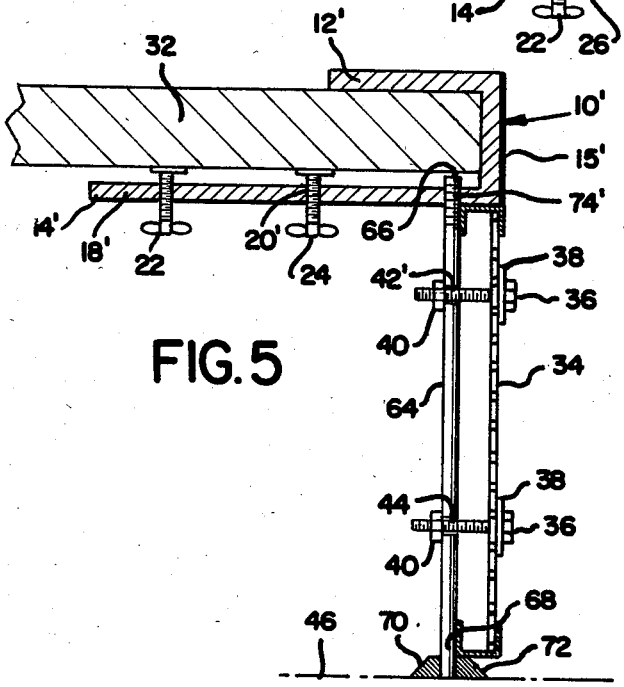
FIG. 5 is an enlarged, cross sectional view similar to FIG. 4 showing a modified clamp construction.

In the embodiment illustrated in FIG. 5, a modified clamp construction 10' is illustrated wherein an upper leg 12' is fabricated to be parallel to and upwardly spaced from a lower leg 14' by a short vertical support 15'. The lower horizontal leg 14' is provided with threaded openings 18', 20' to receive therein in threaded engagement the thumb bolts 22, 24 to secure the modified clamp 10' to the sewer inlet cover 32 in a secure manner. In an alternate construction to the embodiment illustrated in FIGS. 1 and 2, a forward portion of the lower horizontal leg 14' is provided with a threaded opening 74 to threadedly receive therein the upper threaded section 66 of a sturdy, vertical support rod or cylindrical component 64.

The lower end of the vertical support rod 64 is provided with a lower threaded section 68 to threadedly engage a threaded socket 72 which is provided in a lower mounting cup 70. Accordingly, the vertical support rod 64 can be easily, threadedly engaged within the threaded opening 74 in the lower leg 14' and in the threaded socket 72 in the mounting cup 70. The mounting cup 70 can then be securely positioned upon the street surface 46 in a known manner to provide resistance either vertically downwardly directed forces or laterally directed forces. Once the vertical support rod 64 has been properly positioned, the bolt openings 42', 44' provided therein should be forwardly aligned to receive therethrough in usual manner the bolts 36 which can be secured by applying conventional nuts 40 in the usual manner. Optionally, the openings 42', 44' could be threaded to directly threadedly receive the bolts 36 without requiring any nuts 40. The sewer inlet opening protective screen 34 can thus be secured to the vertical support rod 64 in a manner similar to that illustrated in FIGS. 2 and 3.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather only by the scope of the claims appended hereto.

What is claimed is:

1. An inlet clamp for affixing to a cover over a sewer inlet above a surface comprising a generally F-shaped bracket having a vertical leg and a pair of interconnected upper and lower horizontal legs affixed to the vertical leg, the inlet clamp extending in height from the inlet cover to the surface; and, securing means positioned in one of the horizontal legs to affix the bracket to the inlet cover.

2. The inlet clamp of claim 1 and a protective screen overfitting the sewer inlet, the screen being adapted to be secured to the bracket.

3. The inlet clamp of claim 2 and fastening means in the bracket to secure the screen to the bracket in a position to overfit the sewer inlet.

4. The inlet clamp of claim 3 wherein the sewer inlet cover has a top surface and wherein the upper horizontal leg overfits the said top surface and the lower horizontal leg underfits the said bottom surface.

5. The inlet clamp of claim 4 wherein the securing means is positioned in the lower horizontal leg.

6. The inlet clamp of claim 5 wherein the securing means comprises at least a first opening in the lower horizontal leg and a clamping member that is axially movable through the first opening.

7. The inlet clamp of claim 6 wherein the clamping member comprises a threaded bolt and wherein the first opening is threaded, whereby the axial movement of the bolt includes threadedly turning the bolt.

8. The inlet clamp of claim 7 wherein the threaded bolt comprises a bearing plate which bears against the bottom side of the inlet cover when the bracket is affixed to the inlet cover.

9. The inlet clamp of claim 3 wherein the said fastening means comprises a securing member adapted to secure the screen to the vertical leg.

10. The inlet clamp of claim 9 wherein the fastening means comprises at least a second opening in the vertical leg and wherein the securing member is axially movable through the second opening.

11. The inlet clamp of claim 9 wherein the lower horizontal leg comprises a forward terminus and wherein the vertical support leg connects to the lower horizontal leg rearwardly of the said forward terminus to define a recessed area, the screen being positioned in the recessed area.

12. Ihe inlet clamp of claim 11 wherein the second opening is threaded and wherein the securing member is threadedly engaged in the second opening.

13. The inlet clamp of claim 1 wherein the surface is a street and the cover is spaced above the street, the vertical leg extending in length a distance at least as great as the height of the cover above the street.

14. The inlet clamp of claim 13 wherein the vertical leg terminates downwardly in a blunt end and wherein the blunt end contacts the surface when the bracket is secured to the inlet cover.

15. The inlet clamp of claim 13 wherein the vertical leg terminates downwardly in a lower terminus and wherein the lower terminus is positioned below the surface when the bracket is secured to the inlet cover.

16. The inlet clamp of claim 13 wherein the lower terminus is pointed.

17. The inlet clamp of claim 1 wherein the vertical leg comprises an elongated cylindrical component, the cylindrical component extending from the lower horizontal leg to the said surface.

18. The inlet clamp of claim 17 and a mounting cup mounted upon the surface, the mounting cup being provided with an upwardly open recess, and wherein a lower portion of the cylindrical component is secured within the recess.

19. The inlet clamp of claim 18 wherein the cylindrical component is threadedly secured in the lower horizontal leg.

20. The inlet clamp of claim 19 wherein the cylindrical component is threadedly secured in the mounting cup recess.

* * * * *